US005333907A

United States Patent [19]

Schaeffer

[11] Patent Number: 5,333,907

[45] Date of Patent: Aug. 2, 1994

[54] COMBINATION BOOK WITH MAGNIFYING PAGE INSERT

[76] Inventor: Dorothy V. B. Schaeffer, 84 Fawnvue Dr., McKees Rocks, Pa. 15136

[21] Appl. No.: 107,594

[22] Filed: Aug. 18, 1993

[51] Int. Cl.[5] ..... B42D 5/00

[52] U.S. Cl. ..... 281/42; 281/38; 359/802; 359/809

[58] Field of Search ..... 281/38, 3.1, 2, 51, 281/42; 359/802, 803, 804, 809, 810, 440

[56] References Cited

U.S. PATENT DOCUMENTS

| | | | |
|---|---|---|---|
| 1,886,747 | 11/1932 | Schroder | 359/803 |
| 3,140,883 | 7/1964 | Anthony | 281/42 |
| 3,209,648 | 10/1965 | Chapman | 359/809 |
| 3,324,823 | 6/1967 | Peters | 281/42 |
| 4,379,618 | 4/1983 | Tall | 359/804 |
| 4,457,585 | 7/1984 | DuCorday | 350/235 |
| 5,048,928 | 9/1991 | Davis | 359/809 |
| 5,061,052 | 10/1991 | DeJesus | 359/742 |

OTHER PUBLICATIONS

Bausch & Lomb advertisement for Sight Savers, Magna-Thin & Magna-Page Magnifiers (publication date unknown).

*Primary Examiner*—Richard K. Seidel
*Assistant Examiner*—Hwei-Siu Payer
*Attorney, Agent, or Firm*—Webb Ziesenheim Bruening Logsdon Orkin & Hanson

[57] ABSTRACT

A magnifying insert for a book having a transparent first section, a flexible second section fixedly attached to the first section and a magnifying lens section fixedly attached to the second section. The first section can include a first surface and a second surface having a transparent, pressure-sensitive adhesive applied to the second surface adapted to adhere to the front cover and the back cover. The magnifying insert can be made of a plastic and more particularly, the magnifying lens section can be made of an acrylic material. A tab can be attached to the magnifying lens section.

22 Claims, 5 Drawing Sheets

COMBINATION BOOK WITH MAGNIFYING PAGE INSERT

BACKGROUND OF THE INVENTION

1. Field of the Invention

This invention relates generally to an insert for a book and, more particularly, to an insert containing a magnifying sheet for use in a book to enable one to read and observe the fine print on the pages of the book.

2. Description of the Prior Art

Many books, such as phone books, utilize fine print and other indicia. Some people have trouble reading the fine print. Reading glasses or a magnifying glass generally correct this problem. However, in many cases, the reader cannot locate the reading glasses or the magnifying glass when he or she needs it. Further, reading glasses and magnifying glasses are prone to be misplaced. Furthermore, the reading glasses or magnifying glass may be located at a different location from the book. This can be very inconvenient to the reader, for example, if an arthritic reader wants to use a phone book on the first floor of a house and the reading glasses or magnifying glass is on a second floor, it can be very painful and difficult for the reader to climb a flight of steps to get the reading glasses or magnifying glass.

Accordingly, it is the object of the present invention to provide a magnifying aid for use with a book having indicia, such as fine print, that cannot be misplaced and is always in close proximity to the book.

SUMMARY OF THE INVENTION

I have invented a magnifying insert for a book with pages having a front cover attached to a back cover and the pages positioned therebetween, wherein the front cover, the pages and the back cover open about an axis in a longitudinal direction. The insert includes a transparent first section, a flexible second section fixedly attached to the first section and a magnifying lens section fixedly attached to the second section. The first section includes a first surface and a second surface wherein a transparent, pressure-sensitive adhesive is applied to the second surface that is adapted to adhered to the front cover and/or the back cover. A first crease is defined between the first section and the second section and a second crease is defined between the second section and the magnifying lens section. The creases extend in the longitudinal direction. A tab is attached to one of the second section and the magnifying lens section, preferably, the tab attaches to the magnifying lens section. The first section, the second section and the magnifying lens section can be made of a polymeric material, such as an acrylic material. The first section, the second section and the magnifying lens section can be rectangular in shape and the magnifying lens section can be the same size as one of the front cover, the back cover and the pages of the book. Further, the first section can be integrally attached to the second section. The first section can be attached to a jacket, which is adapted to receive the book front cover and book back cover. .

DESCRIPTION OF THE PREFERRED EMBODIMENTS

Figure 1:
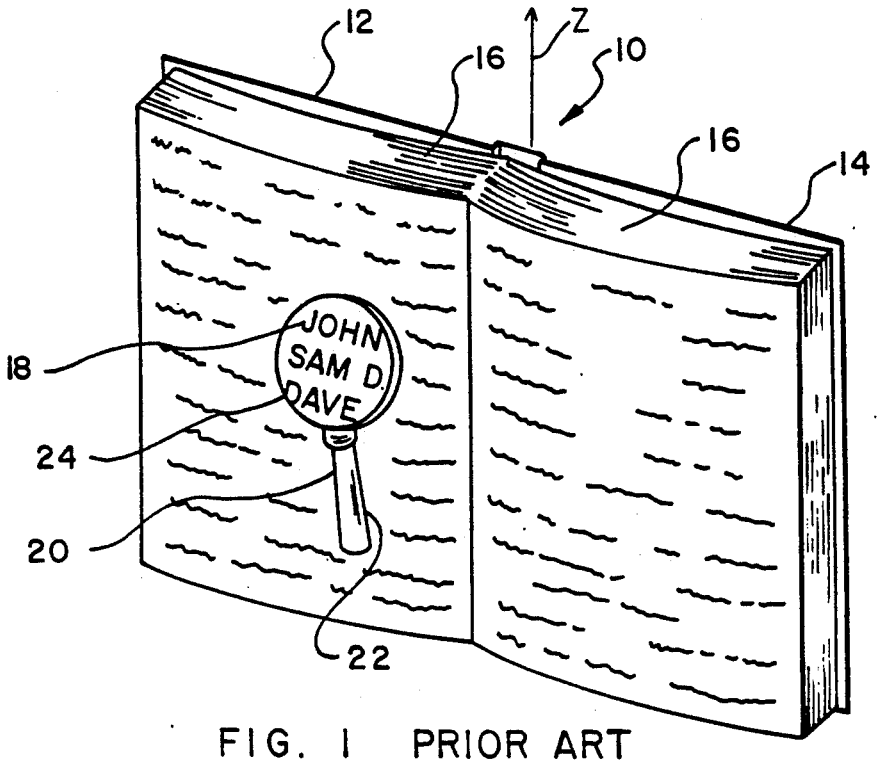
FIG. 1 PRIOR ART
FIG. 1 is a perspective front view of a book and a prior art magnifying glass.

FIG. 1 shows a book 10 having a front cover 12 attached to a back cover 14. A plurality of pages 16 having written indicia 18 on them are attached to the front cover 12 and back cover 14. The indicia 18 is a fine print, such as the print of a telephone book. The front cover 12, back cover 14 and pages 16 can be opened about an axis in the Z direction.

In cases where the reader has difficulty reading the fine print or other indicia 18, he/she uses a magnifying glass 20 having a handle 22 and magnifying lens 24. The user positions the magnifier a distance away from the page 16 so as to assist himself/herself in discerning the indicia, as shown in FIG. 1.

Figure 2:
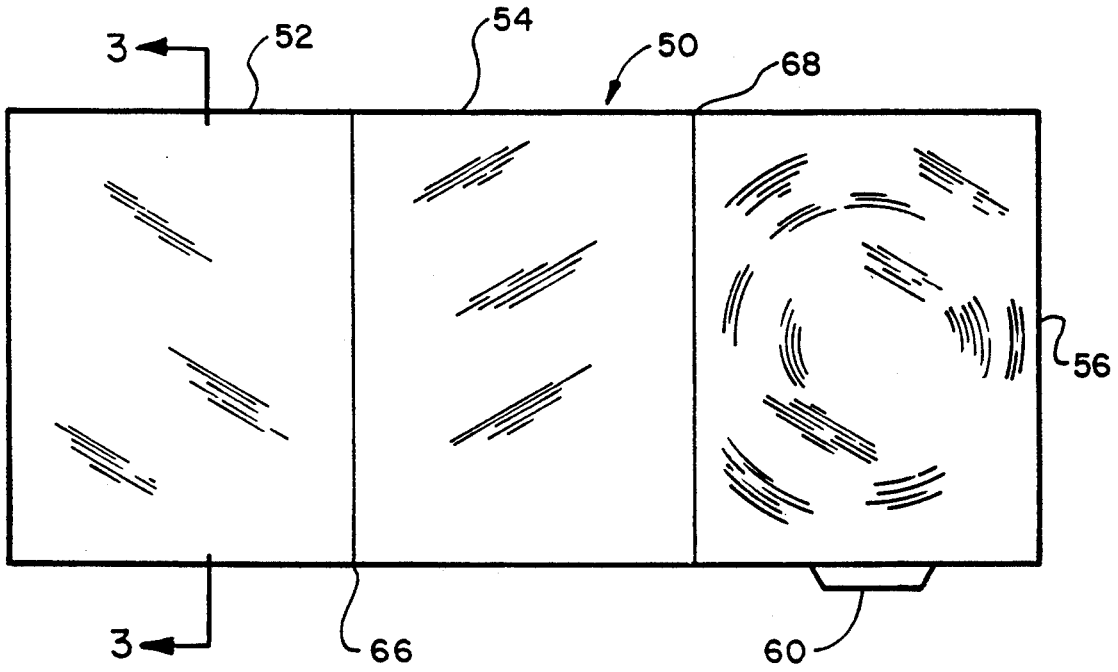
FIG. 2 is a front view of a magnifying insert made in accordance with the present invention.
Figure 3:
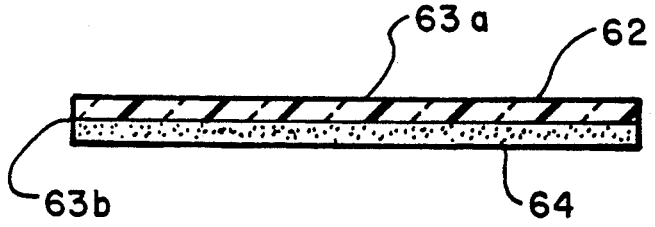
FIG. 3 is a section on line III—III of FIG. 2.
Figure 4:
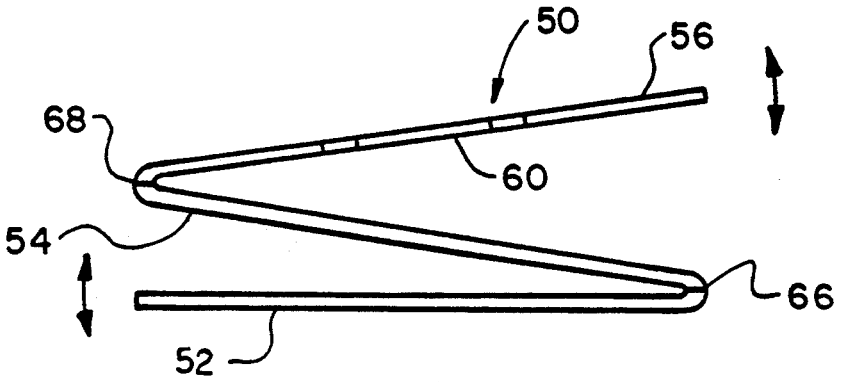
FIG. 4 is a side view of the magnifying insert in a folded state made in accordance with the present invention.

FIGS. 2–9 show a magnifying insert 50, made in accordance with the present invention. As shown in FIGS. 2 and 4, the magnifying insert 50 includes a rectangular, transparent first section 52 fixedly attached to a flexible second section 54 and a magnifying lens section 56. The second section 54 can be transparent or opaque. Magnifying lens section 56 is fixedly attached to the flexible second section 54. One such magnifying sheet is the Sight Savers TM brand, Magnithin ® and Magnipage TM magnifiers, manufactured by Bausch & Lomb. These magnifiers are made of an optical grade acrylic forming fresnol lens. Preferably, sections 52, 54 and 56 are made of plastic or other polymeric material. Preferably, the magnifying lens section 56 is about the same size as a page 16 and/or the front cover 12 and back cover 14. A tab 60 is provided on the magnifying lens section 56. However, a tab 60 could be attached to the first section 52 or second section 54.

As shown in FIG. 3, the transparent first section 52 includes a transparent plastic layer 62 with a first surface **63*a* and a second surface 63*b* wherein a transparent adhesive layer 64 is applied to surface 63*b* of the plastic layer 62. Preferably, the adhesive layer 64 is a pressure-sensitive adhesive, which is well known in the art. As shown in FIGS. 2 and 4, creases 66 and 68 extending in the Z direction are provided to define the first section 52, second section 54 and magnifying lens section 56 and permit magnifying insert 50 to be folded along the creases 66 and 68 in a retracted state. Preferably, first section 52 integrally attaches to second section 54, and second section 54 attaches to section 56 by heating, welding or melting. However, sections 52, 54 and 56** can be chemically bonded, for example, by adhesives or mechanically attached to the respective sections.

Figure 5:
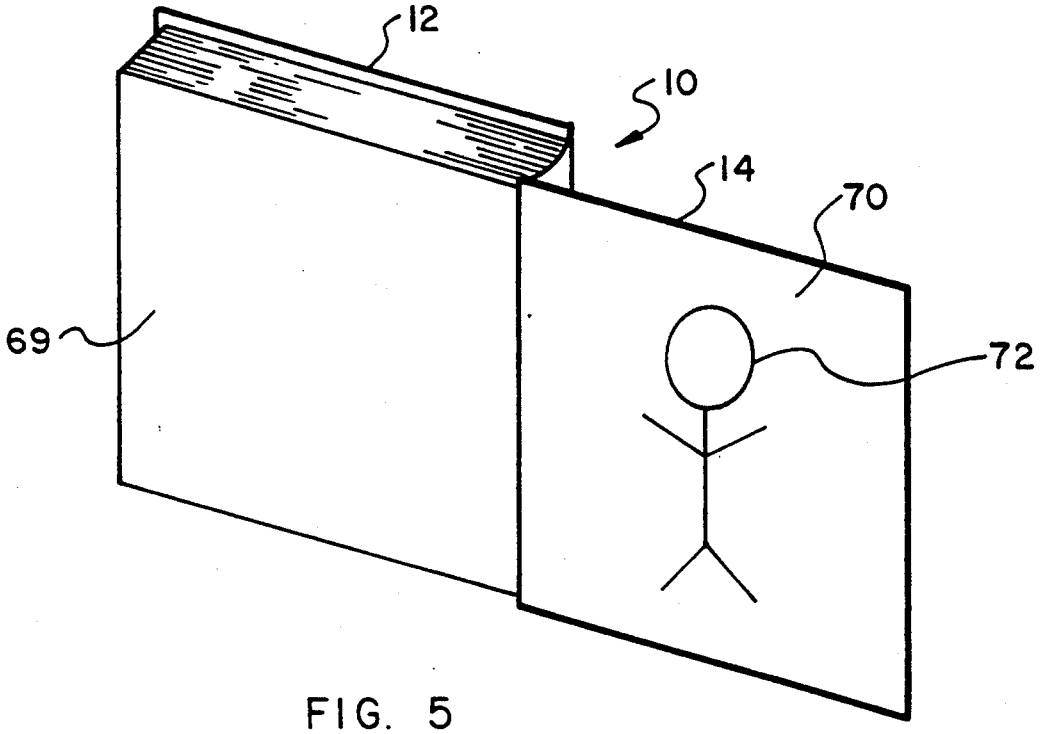
FIG. 5 is a front perspective view of the magnifying insert attached to the book in a folded state.
Figure 6:
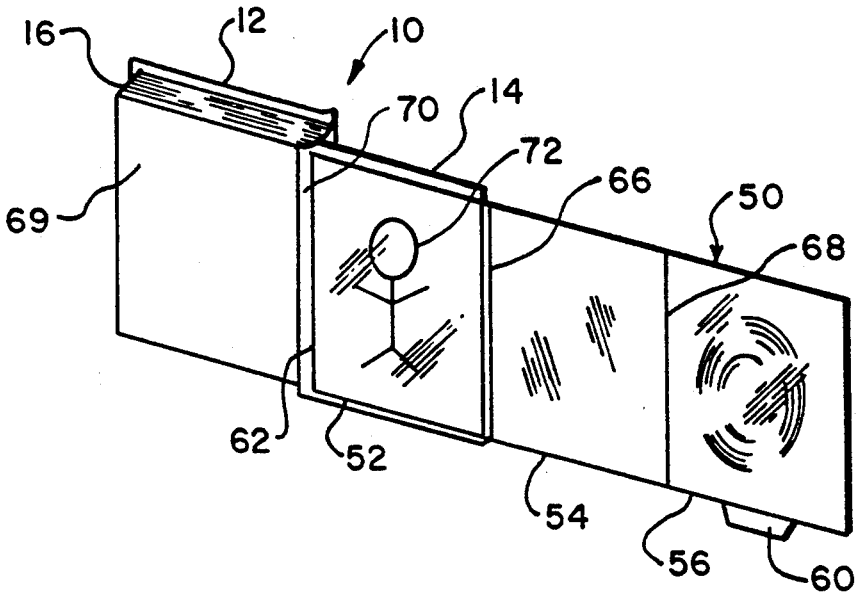
FIG. 6 is the magnifying insert in an extended state attached to the book.

As shown in FIG. 5, the book 10, which is in an open position, also includes a last page 69 and an inner surface 70 of the back cover 14. The inner surface 70 includes printed indicia 72. The magnifying insert 50 is adapted to attach to the inner surface 70 of back cover 14 or an inner surface of front cover 12 by the adhesive layer 64. Specifically, as shown in FIG. 6, the transparent first section 52 fixedly attaches to inner surface 70 by the adhesive layer 64 which is sandwiched between plastic layer 62 and inner surface 70 of back cover 14. Alternatively, the adhesive layer 64 could be eliminated and the transparent section 52 can be attached to the back cover by staples or other mechanical fasteners. The transparent first section 52 does not prevent viewing of the indicia 72 by the user.

Figure 7:
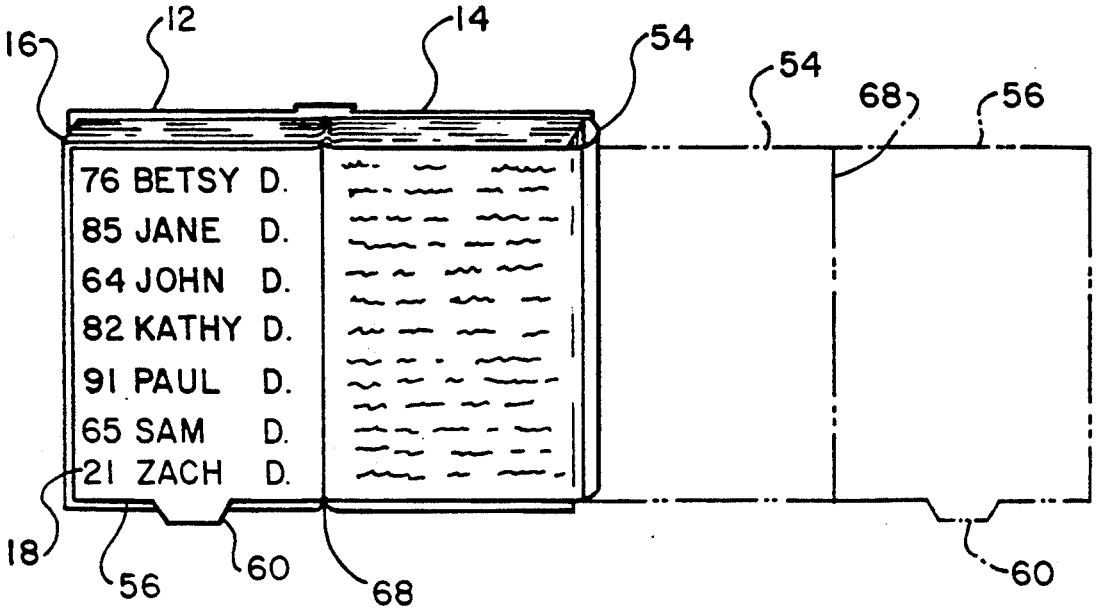
FIG. 7 is a front perspective view of the magnifying insert magnifying fine print of the book.
Figure 8:
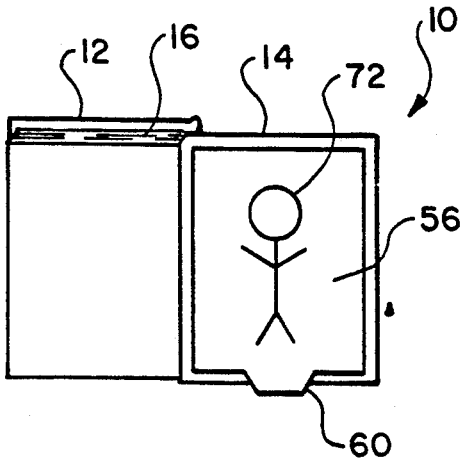
FIG. 8 is a front perspective view of the magnifying insert attached to the last page of the book in a retracted state.
Figure 9:
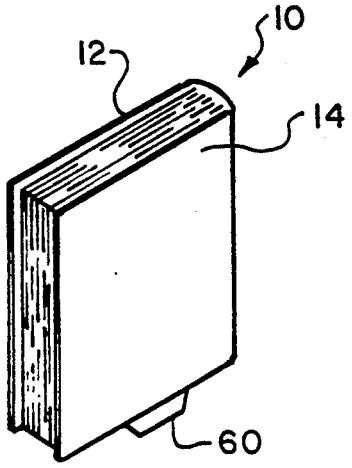
FIG. 9 is the book in a closed position with the magnifying page insert in a closed, retracted state.

The operation of the magnifying insert 50 is as follows. First the reader turns to page 16 having fine print or indicia 18. Then the magnifying lens section 56 is positioned adjacent to page 16 so as to properly magnify the indicia 18 as shown in FIG. 7. The second section 54 is of sufficient length to permit the magnifying lens section to be properly positioned adjacent page 16 to permit magnification of the indicia 18. After the indicia 18 is read, the book 10 can be closed, whereby the magnifying lens 56 acts as a book mark. Alternatively, as shown in FIG. 8, the insert sections 52 and 54 can be folded in the retracted state resting against back cover 14. When the book 10 is in the closed position, as shown in FIG. 9, the insert 50 is generally hidden from view except for tab 60, which assists the user in locating the magnifying lens section 56, whether it is used as a book mark or sandwiched between cover 14 and page 69. Hence, the magnifying insert 50 always remains with the book 10 and cannot be misplaced from the book 10 since it is attached thereto. Further, by providing the magnifying lens section 56 to be approximately the same size as the book cover 12 or 14 and pages 16, the magnifying sheet need not be moved around the page 16 to read indicia 18. This overcomes the inconvenience of using a magnifying glass and only being able to read a portion of the indicia. Further, this feature in conjunction with the creases 66 and 68 improve the life of the insert 50. The magnifying lens section 56, because of its size, need not be moved about a page that could result in fatigue failure of sections 52 and 54. Creases 66 and 68 ensure that the insert 50 is properly folded when not in use, which minimizes the possibility of accidental ripping of the insert 50. Alternatively, section 52 can have a cut-out opening approximately the size of the cover and an adhesive border to stick to the cover. Furthermore, a second magnifying lens section can be provided and attached to section 56 so that two adjacent pages 16 can be read without movement of section 56.

Figure 10:
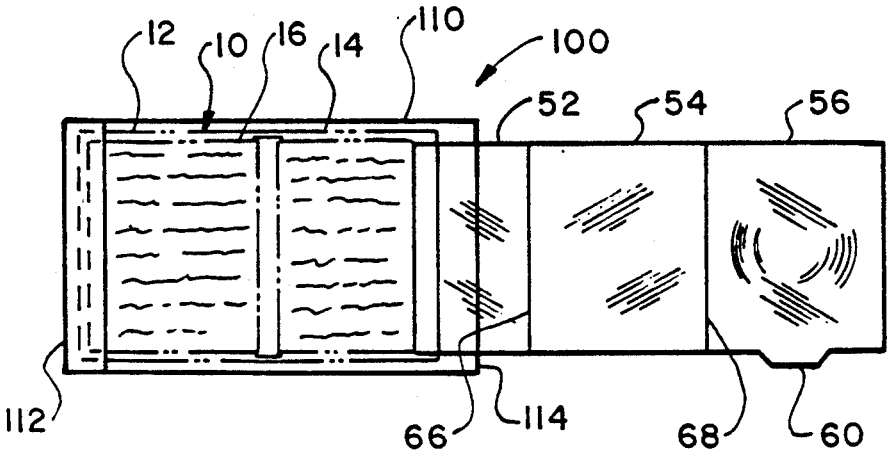
FIG. 10 is the magnifying insert attached to a book jacket cover.

FIG. 10 shows a second embodiment 100 of the present invention and discloses a book cover jacket 110 that includes a front sleeve 112 and a back sleeve 114. Sleeves 112 and 114 are adapted to receive front cover 12 and back cover 14 of the book 10, respectively. Typically, such jackets are provided on new books and act as dust covers. In many cases, these jackets are made of paper or plastic material. First section 52 adhesively bonds to sleeve 114. Section 52 could also be mechanically attached, by stapling for example, to sleeve 114. Sections 54 and 56 are attached to section 52 in a manner previously described. The magnifying insert 50 operates in the same manner, as previously discussed, when the jacket 110 receives the book 10.

Alternatively, sleeve 114 could be integrally attached to section 54 thereby eliminating section 52 altogether. This arrangement would be preferable when providing a combination book cover jacket and magnifying insert.

Figure 11:
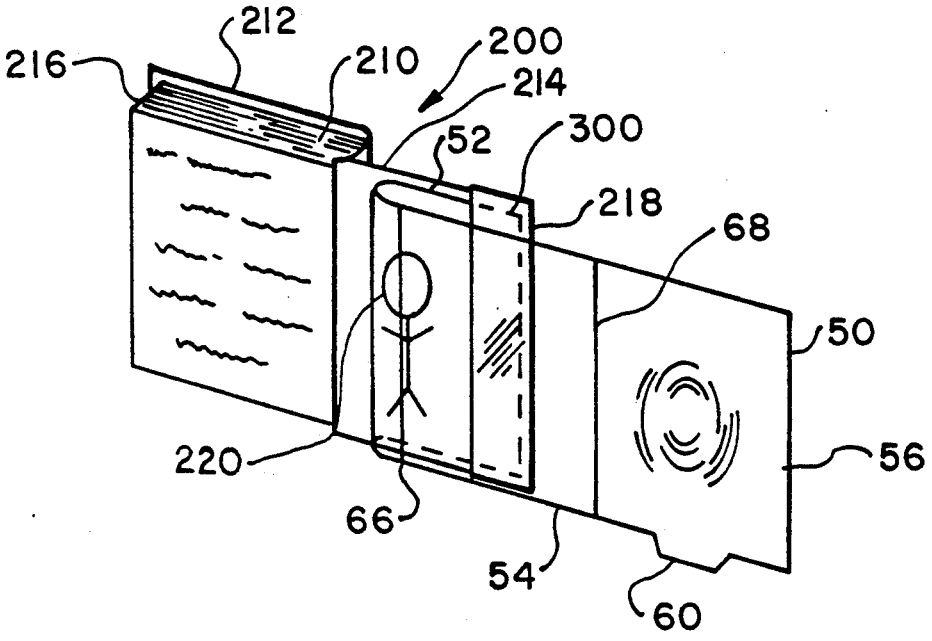
FIG. 11 is the magnifying insert received by a book pocket.

FIG. 11 shows a third embodiment 200 of the present invention and includes a book 210 having a front cover 212, a back cover 214, and pages 216 therebetween; pages 216 include printed indicia (not shown). The book 210 also includes a pocket 218 and printed indicia 220 on back cover 214. A forward portion 300 of section 52 of the magnifying insert 50 is received in the pocket 218 and attaches to either the pocket 218 or the back cover 214 by the adhesive layer 64 or alternatively, by mechanical fasteners such as by staples. The magnifying insert 50 operates in the same manner as previously discussed.

Having described the presently preferred embodiments of the present invention, it is to be understood that it may be otherwise embodied within the scope of the appended claims.

I claim:

1. A magnifying insert for a book with pages having a front cover attached to a back cover and the pages positioned therebetween wherein the front cover, the pages, and the back cover open about an axis in a longitudinal direction, comprising:

a transparent first section;

a flexible second section fixedly attached to said first section;

a magnifying lens section fixedly attached to said second section; and a first crease defined between said first section and said second section, and a second crease defined between said second section and said magnifying lens section, said first crease and said second crease each extending in the longitudinal direction.

2. A magnifying insert for a book, as claimed in claim 1, wherein said first section includes a first surface and a second surface, and further comprising a transparent pressure-sensitive adhesive applied to said second surface adapted to adhere to one of the front cover and the back cover.

3. A magnifying insert for a book, as claimed in claim 1, further comprising a tab attached to one of said first section, second section and said magnifying lens section.

4. A magnifying insert for a book, as claimed in claim 4, wherein said tab attaches to said magnifying lens section.

5. A magnifying insert for a book, as claimed in claim 1, wherein said first section, said second section and said magnifying lens section are made of a polymeric material.

6. A magnifying insert for a book, as claimed in claim 1, wherein said magnifying lens section is made of acrylic.

7. A magnifying insert for a book, as claimed in claim 1, wherein said first section, said second section and said magnifying lens section are rectangular in shape, said magnifying lens section is substantially the same size as one of the front cover, the back cover and the pages.

8. A magnifying insert for a book, as claimed in claim 1, wherein said first section is integrally attached to said second section.

9. A magnifying insert for a book as claimed in claim 1, further comprising:

a jacket adapted to receive the book front cover and the back cover, said first section attached to said jacket.

10. A magnifying insert for a book, as claimed in claim 9, wherein said jacket includes a front sleeve and a back sleeve, wherein said first section attaches to one of said front sleeve and said back sleeve.

11. In combination, a book comprising: a front cover; a back cover attached to said front cover and pages positioned therebetween having indicia thereon; and a magnifying insert comprising: a transparent first section attached to one of said front cover and said back cover, a flexible second section fixedly attached to said first section, a magnifying lens section fixedly attached to said second section, a first crease defined between said first section and said second section, and a second crease defined between said second section and said magnifying lens section, wherein the second section is of sufficient length to permit the magnifying lens section to be positioned adjacent to said indicia to create a magnified image of said indicia.

12. A magnifying insert for a book, as claimed in claim 11, wherein said first section includes a first surface and a second surface, and further comprising a transparent pressure-sensitive adhesive applied to said second surface and sandwiched between said first section and one of said front cover and said back cover.

13. A magnifying insert for a book, as claimed in claim 11, further comprising a tab attached to one of said second section and said magnifying lens section.

14. A magnifying insert for a book, as claimed in claim 13, wherein said tab attaches to said magnifying lens section.

15. A magnifying insert for a book, as claimed in claim 11, wherein said first section, said second section and said magnifying lens section are made of a polymeric material.

16. A magnifying insert for a book, as claimed in claim 11, wherein said magnifying lens section is made of acrylic.

17. A magnifying insert for a book, as claimed in claim 11, wherein said first section is integrally attached to said second section.

18. A magnifying insert for a book having a front cover attached to a back cover wherein said front cover and said back cover open about an axis in a longitudinal direction, comprising:

a transparent first section having a first surface and a second surface with a transparent pressure-sensitive adhesive applied to said first surface adapted to adhere to a cover of a book;

a flexible second section integrally attached to said first section; and a magnifying lens section fixedly attached to said second section substantially the same size as said back cover, wherein a first crease is defined between said first section and said second section, and a second crease is defined between said second section and said magnifying lens section, said first crease and said second crease each extending in a longitudinal direction, wherein said first section, said second section and said magnifying lens section are made of a polymeric material, and a tab attached to one of said first section, second section and magnifying lens section.

19. A magnifying insert for a book with pages having a front cover attached to a back cover and the pages positioned therebetween wherein the front cover, the pages, and the back cover open about an axis in a longitudinal direction, comprising:

a transparent first section;

a flexible second section fixedly attached to said first section;

a magnifying lens section fixedly attached to said second section; and a tab attached to one of said first section, second section and said magnifying lens section.

20. A magnifying insert for a book, as claimed in claim 19, wherein said tab attaches to said magnifying lens section.

21. In combination, a book comprising: a front cover; a back cover attached to said front cover and pages positioned therebetween having indicia thereon; and a magnifying insert comprising: a transparent first section attached to one of said front cover and said back cover, a flexible second section fixedly attached to said first section, a magnifying lens section fixedly attached to said second section, wherein the second section is of sufficient length to permit the magnifying lens section to be positioned adjacent to said indicia to create a magnified image of said indicia, and a tab attached to one of said second section and said magnifying lens section.

22. A magnifying insert for a book, as claimed in claim 21, wherein said tab attached to said magnifying lens section.

* * * * *

UNITED STATES PATENT AND TRADEMARK OFFICE

CERTIFICATE OF CORRECTION

PATENT NO. : 5,333,907

DATED : August 2, 1994

INVENTOR(S) : Dorothy V. B. Schaeffer

It is certified that error appears in the above-indentified patent and that said Letters Patent is hereby corrected as shown below:

Claim 4 Line 50 Column 4 "4" should read --3--.

Claim 22 Line 47 Column 6 "attached" should read --attaches--.

Signed and Sealed this

Twenty-seventh Day of September, 1994

*Attest:*

Bruce Lehman

BRUCE LEHMAN

*Attesting Officer*

*Commissioner of Patents and Trademarks*